US005809911A

United States Patent [19]

Feizollahi

[11] Patent Number: 5,809,911

[45] Date of Patent: Sep. 22, 1998

[54] MULTI-ZONE WASTE PROCESSING REACTOR SYSTEM

[75] Inventor: Fred Feizollahi, San Ramon, Calif.

[73] Assignee: Allied Technology Group, Inc., Fremont, Calif.

[21] Appl. No.: 842,642

[22] Filed: Apr. 16, 1997

[51] Int. Cl.[6] ..... B01J 20/34

[52] U.S. Cl. ..... 110/346; 110/250; 588/201; 219/121.38

[58] Field of Search ..... 110/250, 346, 110/235; 588/201; 219/121.36–121.38, 121.59

[56] References Cited

U.S. PATENT DOCUMENTS

| | | |
|---|---|---|
| 4,299,611 | 11/1981 | Penberthy . |
| 4,438,706 | 3/1984 | Boday et al. . |
| 4,508,040 | 4/1985 | Santen et al. . |
| 4,509,434 | 4/1985 | Boday et al. . |
| 4,602,991 | 7/1986 | Kulkarni . |
| 4,644,877 | 2/1987 | Barton et al. . |
| 4,729,891 | 3/1988 | Kulkarni . |
| 4,770,109 | 9/1988 | Schlienger . |
| 4,863,702 | 9/1989 | Galloway et al. . |
| 4,874,587 | 10/1989 | Galloway . |
| 4,896,614 | 1/1990 | Kulkarni . |
| 4,919,190 | 4/1990 | Newman et al. . |
| 4,980,092 | 12/1990 | Pineau et al. . |
| 4,989,522 | 2/1991 | Cline et al. . |
| 5,005,494 | 4/1991 | Schlienger . |
| 5,010,829 | 4/1991 | Kulkarni . |
| 5,090,340 | 2/1992 | Burgess . |
| 5,136,137 | 8/1992 | Schlienger . |
| 5,138,959 | 8/1992 | Kulkarni . |
| 5,281,790 | 1/1994 | Nguyen Handfield et al. . |
| 5,288,969 | 2/1994 | Wong et al. . |
| 5,292,395 | 3/1994 | Galloway . |
| 5,369,947 | 12/1994 | Dummersdorf et al. . |
| 5,427,738 | 6/1995 | Galloway . |
| 5,434,333 | 7/1995 | Jantzen et al. . |

*Primary Examiner*—Henry A. Bennett
*Assistant Examiner*—Susanne C. Tinker
*Attorney, Agent, or Firm*—Stoel Rives LLP

[57] ABSTRACT

The novel waste treatment system of the invention employs multiple reactor zones for processing heterogeneous waste. In one embodiment, the reactor system (10) includes the following components: first (12) and second (14) solid waste feed subsystems; and liquid waste feed subsystem (16); a plasma torch assembly (18) for heating a first chamber (20) of the reactor system (10); a joule effect heater assembly (22) for heating a second chamber (24); a gaseous effluent processing subsystem (26); a metal discharge recycling subsystem (28); and first (30) and second (32) slag discharge processing subsystems. In an alternative embodiment, each of the reactor zones is heated by joule effect heaters. The reactor system (10) can be operated in an oxidation or reduction mode. In either mode, the reactor system (10) allows for more complete reaction of a variety of heterogeneous waste.

41 Claims, 7 Drawing Sheets

MULTI-ZONE WASTE PROCESSING REACTOR SYSTEM

FIELD OF THE INVENTION

The present invention relates generally to multi-zone reactor systems for processing waste and, in particular, to a multi-zone reactor system for destruction, vitrification and recycling of solid, liquid and/or mixed-phase waste.

BACKGROUND OF THE INVENTION

Processing of waste and especially hazardous waste, is a continuing problem for many industries and in non-industrial settings. Landfill space is decreasing and costs are rising. Moreover, the shipment and processing of hazardous waste can pose a significant risk to public health and the environment. In view of these concerns, the public and industry have long sought waste processing solutions that reduce waste volume, detoxify hazardous content and/or neutralize or stabilize waste products to prevent undesired spreading through leaching, airborne discharge or the like.

A particularly challenging problem is the treatment and disposal of heterogeneous waste, i.e., waste materials that are highly variable in their chemical composition and physical properties. Such waste may include organics, inorganics and mineral compounds and may be in the form of solids, liquids or mixed phase materials. Heterogeneous waste is produced in many environments including households, semiconductor fabrication facilities, chemical and petrochemical industrial plants, hospitals, military bases, chemical and nuclear weapon production facilities, and fossil fuel and nuclear power plants.

Conventional waste processing reactor systems generally lack the versatility needed to effectively handle a broad range of heterogeneous waste. Such systems typically process waste in a reactor chamber that is heated by one of a plasma torch, induction or joule effect heater. Unfortunately, each of these reactor types has disadvantages for processing certain types of waste. For example, single zone joule effect reactors are problematic for processing waste streams that may contain metallic materials. Joule effect heaters employ a pair of electrodes that extend into the reactor bed to electrically heat the reactor bed as well as the waste contained in the reactor bed. Any molten metallic materials in the waste can provide a conductance path between the electrodes and short-circuit the electrical resistance that generates the joule effect heat. Induction heaters are problematic for other types of waste. In particular, induction heaters are suitable mostly for melting metal and their efficiency and effectiveness are greatly reduced when the waste contains other materials such as cellulose and plastic. Plasma heaters alone may not provide sufficient space for complete reaction and polishing of effluent gases over the reactor bed in certain applications.

It is thus apparent that such conventional single zone joule effect, induction and plasma torch reactors are not fully satisfactory for handling certain waste materials including heterogenous waste.

SUMMARY OF THE INVENTION

The present invention is directed to a multi-zone reactor system and associated method for improved processing of waste including heterogeneous waste. In particular, the apparatus and method of the present invention are useful for processing solid, liquid and mixed phase waste generated in a variety of environments and having correspondingly varied compositions which may include metallic materials, cellulose and plastic material, and hazardous organic components. In its preferred implementations, the present invention addresses numerous objectives including the following: (1) reduction of waste volume, (2) destruction of hazardous organic components, (3) stabilization of toxic metals and compounds into an increasingly non-leachable solid, (4) recovery of reusable products and energy, and (5) release of stable compounds to the surrounding environment. Additional objectives addressed by the present invention will be apparent upon consideration of the description below.

The system of the present invention includes a multi-zone reactor and related subsystems. The multi-chamber reactor includes at least a first chamber containing a first reactor bed and a second chamber containing a second reactor bed. Waste is introduced into the first chamber where it is reacted to yield a first waste by product in the first reactor bed and a first effluent outside of the first reactor bed. In the second chamber, the first effluent is reacted to yield a second reaction product in the second reactor bed and a second effluent outside of the second reactor bed. The apparatus further includes a subsystem for delivering waste into the first chamber of the reactor, a subsystem for processing the first reaction product from the first chamber of the reactor, a subsystem for processing the second reaction product from the second chamber of the reactor and a subsystem for processing the second effluent from the second chamber of the reactor.

The first and second reactor beds can be heated by heaters of the same or different types. In one embodiment, the first reactor bed is heated by a plasma torch and the second reactor bed is heated by a joule effect heater. This embodiment has been found advantageous for handling heterogeneous waste including metallic materials because metallic materials included in the waste are melted by the plasma torch which is not affected by the presence of metals. Moreover, the second reactor chamber provides additional space and retention time for processing a gaseous effluent from the first reactor and allows for settlement of particulates into the second reactor bed for further reaction. In an alternative embodiment, the first and second reactor beds are heated by joule effect heaters. Although such a multi-zone reactor system allows for satisfactory processing a broad range of heterogeneous waste, this embodiment of the invention is preferably employed in applications where any metallic materials have been removed or are otherwise not present in the waste.

The waste delivery subsystem preferably allows for introducing solid and/or liquid or mixed phase waste. Solid waste can be introduced by way of a screw or a ram feeder. Liquid waste can be introduced into the reactor by way of a tank pump for feeding pumpable fluids or slurry. Mixed phase waste that is not pumpable can be separated into solid and liquid components and introduced as set forth above. The subsystems for processing reaction products from the first and second reactor beds preferably include tapping devices disposed at appropriate locations relative to the reactor beds and a container filling apparatus for receiving the reaction products drained from the beds. Depending on the particulars of the process, the drained reaction products can be recycled, or cooled and stabilized for storage or disposal. The container filling apparatus is preferably housed inside an air-tight and appropriately cooled enclosure.

The effluent processing subsystem can include various components depending a upon the nature of the particular process involved and whether it is desired to synthesize and recover process gases, whether it is desired to recover energy from the effluent, etc. In this regard, the effluent processing subsystem may include, inter alia, any or all of the following: a high temperature filter; a quench tower; a gas scrubber; a process fan; a synthesis gas converter for use in connection with reduction mode operation; a high efficiency particulates absolute (HEPA) filter; and a charcoal bed filter.

The associated method of the present invention involves heating a first reactor bed in a first reactor chamber, heating a second reactor bed in a second reactor chamber and introducing waste into the first reactor chamber. In the first reactor chamber, at least a portion of the waste is reacted to yield a first reaction product in the first reactor bed and a first effluent outside of the reactor bed. The effluent is introduced into the second reactor chamber and is at least partially reacted to yield a second reaction product in the second reactor bed and a second effluent outside of the second reactor bed. The method also includes the step of separately processing the reaction products and the second effluent.

Preferably, each of the reactor beds is heated to a temperature of at least 2,000° F. and, more preferably to a temperature of about 2,500° F. The first reactor is preferably heated by a plasma torch heater, and the second reactor is preferably heated by a joule effect heater. The first reactor bed is preferably heated by a joule effect heater. The method of the present invention encompasses operation in an oxidation mode and in a reduction mode. In the oxidation mode, the first effluent is exposed to a source of oxygen. Such oxygen exposure may be accomplished by using air as the gas for operation of a plasma torch (of the first reactor chamber) and/or introducing additional air into the process chambers by way of a blower or the like. For operation in the reduction mode, the plasma torch (if elected for operation of the reactor system) employs an inert gas such as nitrogen or argon as the medium for the plasma torch operation. Additionally, the level of oxygen in the process can be kept to a minimum by installing lock hoppers and maintaining nitrogen blankets at the feed ports.

In accordance with the process of the present invention, the reaction products from the reactor beds can be drained using a tapping device located at discharge ports of the first and second chambers. For metallic reaction products, recycling can be accomplished by adjusting the chemistry in the first reactor chamber so as to allow a phase separation of the metal from the remaining molten product of the reactor bed. Once the metal is separated, it can be allowed to pour out of a discharge port into a cooled ingot. Oxides and minerals can be removed from the reactor beds as slag or glass and poured into containers for setting and storage or disposal as stable, vitrified waste products that are highly leach resistant.

The present invention thus allows for processing of waste including heterogenous waste so as to reduce waste volume, destroy hazardous organic components, stabilize toxic metals and compounds into an increasingly non-leachable solid, recover and reuse products and energy, and release stable components into the environment. Additional objectives and corresponding advantages of the present invention will be apparent to those skilled in the art.

BRIEF DESCRIPTION OF THE DRAWINGS

For a more complete understanding of the present invention and further advantages thereof, reference is now made to the following detailed description taken in conjunction with the drawings in which.

DETAILED DESCRIPTION OF THE INVENTION

In the following description, the present invention is set forth in the context of various alternative embodiments and implementations involving a multi-zone or multi-chamber reactor system for processing heterogeneous waste. It will be appreciated that these embodiments and implementations are illustrative and various aspects of the invention have applicability beyond the specifically described contexts.

Figure 1A:
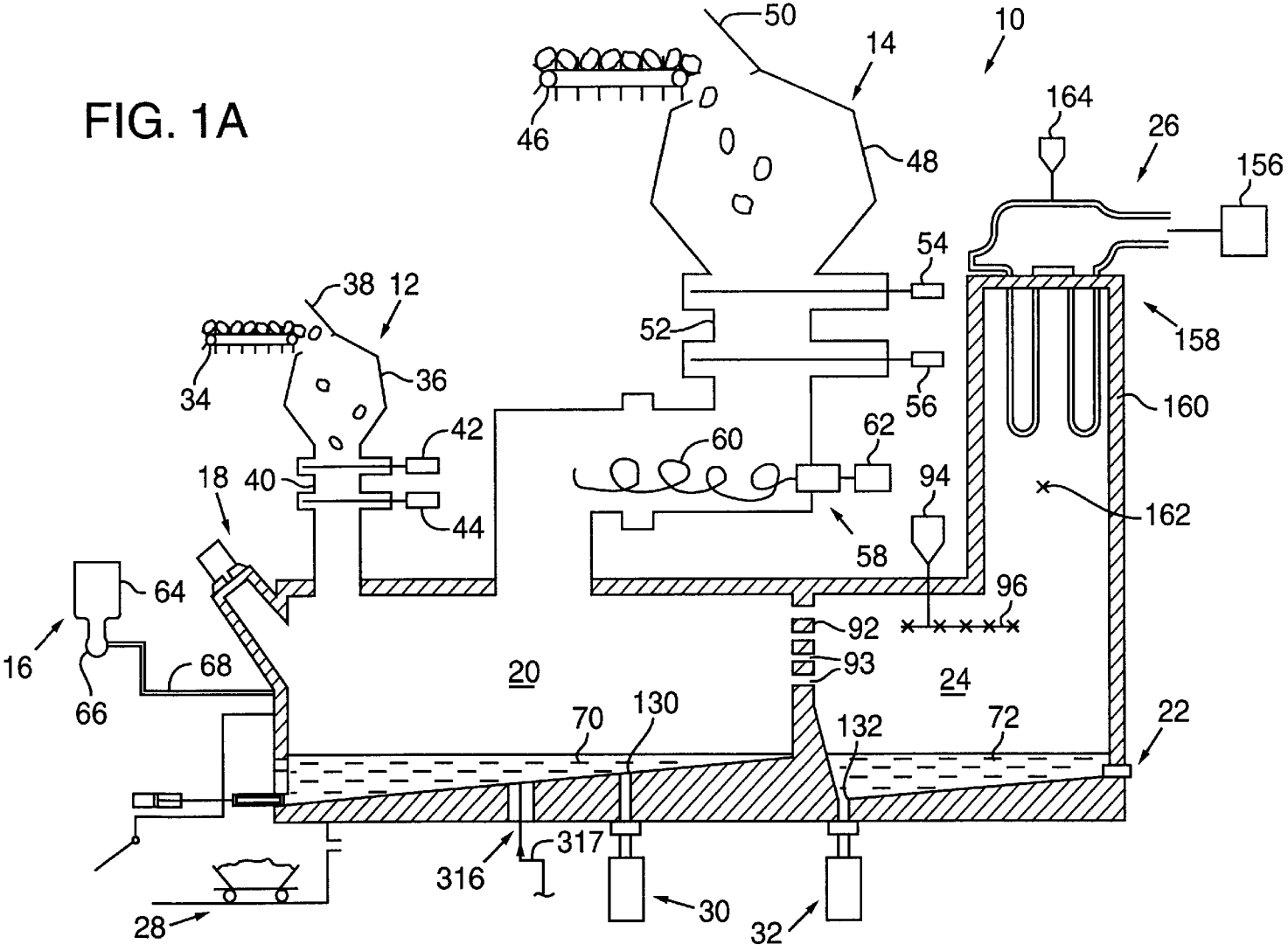
FIG. 1A is a partly schematic diagram illustrating a multi-zone reactor system according to the present invention.

Referring to FIGS. 1A–1E (collectively FIG. 1), a multi-zone reactor system 10, constructed in accordance with the present invention, is shown. More particularly, FIG. 1A shows an overview of the reactor system 10 and FIGS. 1B–1E show details of various portions of the system 10. Generally, the system 10 includes the following components: first 12 and second 14 solid waste feed subsystems; a liquid waste feed subsystem 16; a plasma torch assembly 18 for heating a first chamber 20 of the reactor system 10; a joule effect heater assembly 22 for heating a second chamber 24; a gaseous effluent processing subsystem 26; a discharge recycling subsystem 28; and first 30 and second 32 slag discharge processing subsystems. Each of these components is described in turn below.

The first 12 and second 14 solid waste feed subsystems allow for delivery of a variety of types of generally solid waste into the first chamber 20 of the reactor system 10. By way of example, the solid waste can include compressible, bagged household waste and/or relatively incompressible industrial waste products, e.g., metallic waste. A variety of solid waste delivery subsystems can be employed in accordance with the present invention. In the illustrated embodiment, the first subsystem 12 is a ram feeder for handling generally incompressible solid waste and the second subsystem 14 is a screw feeder for handling compressible solid waste.

As shown, the first subsystem 12 includes a conveyor 34 for delivering solid waste to an intake hopper 36 via a door 38. The door 38, which reduces backflow of potentially hazardous gases to the surrounding environment, is preferably an automatic door that opens only upon sensing the approach of waste. From the intake hopper 36, the waste passes into a lock hopper 40 that is bounded at its ends by hydraulic actuated gate valves 42 and 44. The lock hopper 40 is effective in a reduction mode of operation to reduce the admission of air into the process chambers 20 and 24, as well as to further isolate the surrounding environment from process gases. To introduce waste from the intake hopper 36 into the lock hopper 40, upper valve 42 is opened while lower valve 44 remains closed, after a sufficient quantity of waste is received, valve 42 is closed and the lock hopper 40 is purged using a low oxygen or oxygen free gas, e.g., an inert gas such as nitrogen. Once the hopper 40 has been purged, the lower valve 44 is opened to allow the waste to pass into the first chamber 20 of the reactor system.

The second solid waste feed subsystem 14 has similar components including a conveyor 46, an intake hopper 48 with an automatic door 50, and a purging lock hopper 52 with upper 54 and lower 56 hydraulic actuated gate valves. In addition, the second subsystem 14 of the illustrated embodiment includes a screw feeder 58. The feeder 58 includes an auger like screw element 60 driven by a motor 62. The screw element 60 shreds the waste as the waste is driven towards the first chamber 20 of the reactor system 10 so as to increase subsequent reaction rates, allow for more complete reaction of the waste and reduce the required residence time of the waste in the reactor system 10.

Liquid waste is received into the reactor system 10 by liquid or slurry waste feed subsystem 16. The subsystem 16 includes a liquid waste receptacle 64 and a feed pump 66 for pumping liquid waste from the receptacle 64 into the first chamber 20 of the reactor system 10 via intake line 68. It will thus be appreciated that the first chamber 20 can receive heterogeneous waste in various forms including liquid or slurry waste as well as compressible and relatively incompressible solid waste.

The reactor chambers 20 and 24 are preferably refractory lined to withhold and withstand extremely high temperatures and include first and second reactor beds 70 and 72, respectively. The beds 70 and 72 are preferably formed from liquid glass. Beds 70 and 72 can be maintained in a highly turbulent state by injecting fluid, preferably gases such as air, nitrogen, or oxygen, into the beds, thereby increasing reaction rates.

Figure 1B:
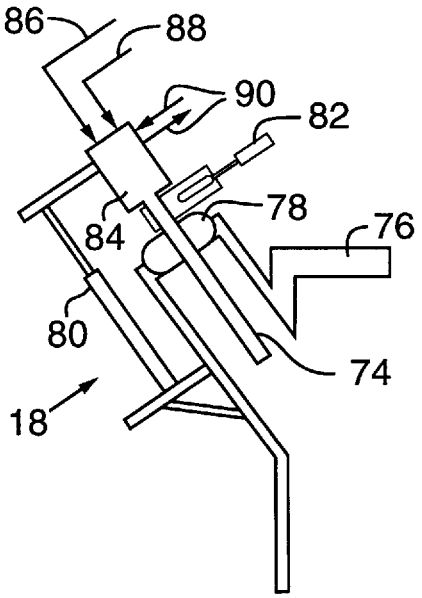
FIG. 1B is a cutaway drawing showing details of the plasma torch mounting of the reactor system of FIG. 1A.

The illustrated reactor system 10 employs a plasma torch assembly 18 to heat the first chamber 20. This implementation is particularly advantageous for processing waste that may include metal as the plasma torch assembly 18 is substantially unaffected by metallic waste. Details of the plasma torch assembly 18 are shown in FIG. 1B. The assembly 18 includes a torch element 74 mounted on chamber wall 76 via water cooled mounting sleeve 78. The element 74 can be inserted or retracted relative to wall 76 by operation of hydraulic cylinder 80. The assembly further includes a hydraulically operated isolation gate valve 82 for isolating the space in the chamber 20 from the outside environment when the torch is withdrawn. The torch element 74 is operative for electrically heating a gas to form a plasma which is directed into the first chamber 20 so as to provide the desired heating. In this regard, electrode casing 84 of torch element 74 includes an electrical input (generally indicated by arrow 86) and a gas input (generally indicated by arrow 88). The electrode casing 84 is cooled by circulating cooling water as indicated by arrows 90.

The plasma torch assembly 18 preferably heats the first chamber 20 to at least about 2500° F. Prior to activating the torch assembly 18, the chamber 20 can be preheated to a temperature of about 2000° F. using a conventional natural gas or propane heating device (not shown). The gas employed by torch assembly 18 can be varied depending, for example, on the desired chemistry of the reaction process. For example, for operation in an oxidation mode, air, oxygen, or a predetermined mixture of combustion gases may be used so as to provide an oxygen source for the reaction. For operation in a reduction mode, an inert gas such as argon or nitrogen may be employed.

The first 20 and second 24 chambers are separated by a shadow wall 92 (FIG. 1A) that has openings 93 that allow gases to pass from the first chamber 20 into the second chamber 24. In the second chamber, additional fluid reactants can be introduced by way of a blower 94 that is piped to a set of mixing nozzles 96. Different reactants may be selected based on the desired chemistry of the reaction. In the oxidation mode, air may be blown in chamber 24. For operation in the reduction mode, water or water vapor is preferred.

Figure 1C:
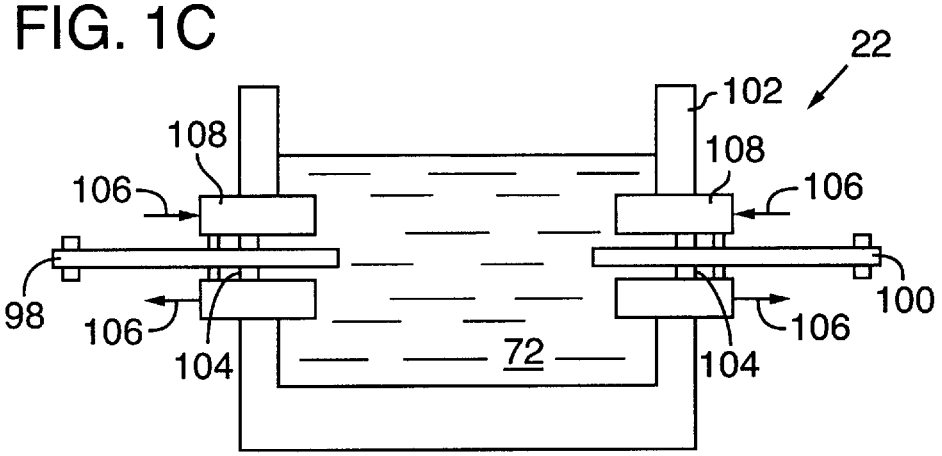
FIG. 1C is a cutaway drawing showing details of the side-mounted joule effect heating electrode assembly of the reactor system of FIG. 1A.

The second chamber is preferably heated by a joule effect heater assembly 22. It should be noted that only one electrode of the assembly is shown in FIG. 1A. FIG. 1C shows more complete details of the assembly 22. The assembly 22 includes a positive electrode 98 and a negative electrode 100, each passing through sidewall 102 and terminating within the molten bed 72. The bed 72 is heated as a result of current passing through the bed 72 between electrodes 98 and 100. A seal is formed between the sidewall 102 and each of the electrodes 98 and 100 by a frozen glass plug 104. The plugs 104 are maintained in a frozen state by circulating cooling water, as generally indicated by arrows 106, through mounting sleeves 108.

The reactions that occur in the chambers 20 and 24 will vary depending on the nature of the waste and whether the oxidation or reduction mode is selected. The intense heat from the plasma heater assembly 18 will generally melt any high boiling point minerals and metals while gasifying any low boiling point metals and minerals and disintegrating any organic compounds. The resulting molten material will reside in the first bed 70 and the resulting gases will pass to the second chamber 24. In the oxidation mode, the reaction of any carbonaceous gases in the joule heated chamber will be a combustion process whereby oxygen in the air reacts with carbon gases to produce stable gases of carbon dioxide and water. Reaction of any mineral and metal gases will involve oxidation whereupon the elements form oxides. Due to the oxidative environment, most halogens such as chlorine will be present in their elemental form such as chlorine gas ($Cl_2$). Sulfur will form $SO_2$ and nitrogen will form various nitrogen oxide compounds ($NO_X$). Low boiling point metals such as mercury, lead, cadmium, chromium, and nickel will convert to their elemental or oxide forms, vaporize and exit the plasma zone. Some metal oxides, due to a higher boiling point than their elemental form, will condense in the joule effect zone and become part of the glass bed 72. The stable gases of carbon dioxide and water along with the volatile metal and mineral gases will flow out of the second chamber 24 into the gaseous effluent processing subassembly 26.

In the reduction mode, as in the oxidation mode, the intense heat in the plasma zone melts high boiling point minerals and metals, gasifies lower boiling point minerals and metals, and disintegrates organic compounds. In the latter regard, carbonaceous materials are gasified to their elemental form such as carbon, hydrogen and other elements. If the reactant injected into the second chamber 24 is water, the carbon will react with the water to form hydrogen and carbon dioxide. Due to the reducing environment, most halogens such as chlorine will be present in a hydrated form such as hydrochloric acid, HCl. Sulfur will form $H_2S$ and nitrogen will form $NH_3$. Low boiling point metals such as mercury, lead, cadmium, chromium, and nickel will convert to their reduced form, vaporize and exit the first chamber 20. The water in the second chamber 24 can be provided as steam at a temperature of 350° F. or higher produced by a boiler or steam superheater to facilitate the endothermic reaction of carbon with oxygen. Upon complete reaction with water in the second chamber, the resulting gas product is a synthesis gas which is a mixture of CO, $CO_2$, $H_2$, $CH_4$ and trace amounts of other organic gases. Additional particulate products (fine solids) will reside in the second bed due to condensation and particle settling.

In both the oxidation and reduction modes, the chambers 20 and 24 will yield separate molten products. These products are removed by the discharge recycling subsystem 28, the first slag discharge processing subsystem 30 and the second slag discharge processing subsystem 32. The discharge recycling subsystem 28 is used to recover and recycle metal for further use. In this regard, when recycling of metals is desired, the chemistry of the melt in the first chamber 20 is adjusted to allow a phase separation between the metal and the remaining molten products which constitute various minerals and oxides referred to as slag. Once separated, the metals are allowed to pour into an ingot and are cooled for reuse, and the slag is allowed to pour into a container for disposal or storage.

Figure 1D:
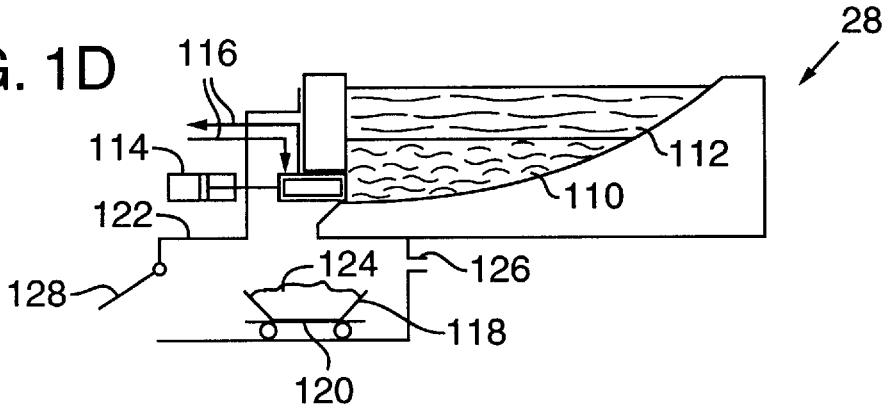
FIG. 1D is a cutaway drawing showing details of the metal tap and container fill (discharge recycling) subsystem of the reactor system of FIG. 1A.

FIG. 1D shows details of the discharge recycling subsystem 28. As shown, the molten product has separated into a molten metal portion 110 and a slag portion 112. A hydraulic actuated plug 114 is located in the area of the molten metal 110. The plug 114 is cooled by circulating water, as generally indicated by arrows 116. When the plug 114 is withdrawn, the molten metal 110 pours into a cast iron mold 118 on a cart 120 in a discharge enclosure 122, where the metal forms an ingot 124. The enclosure 122 has a venting pipe 126 and a door 128 for removal/entry of the cart 120.

Figure 1E:
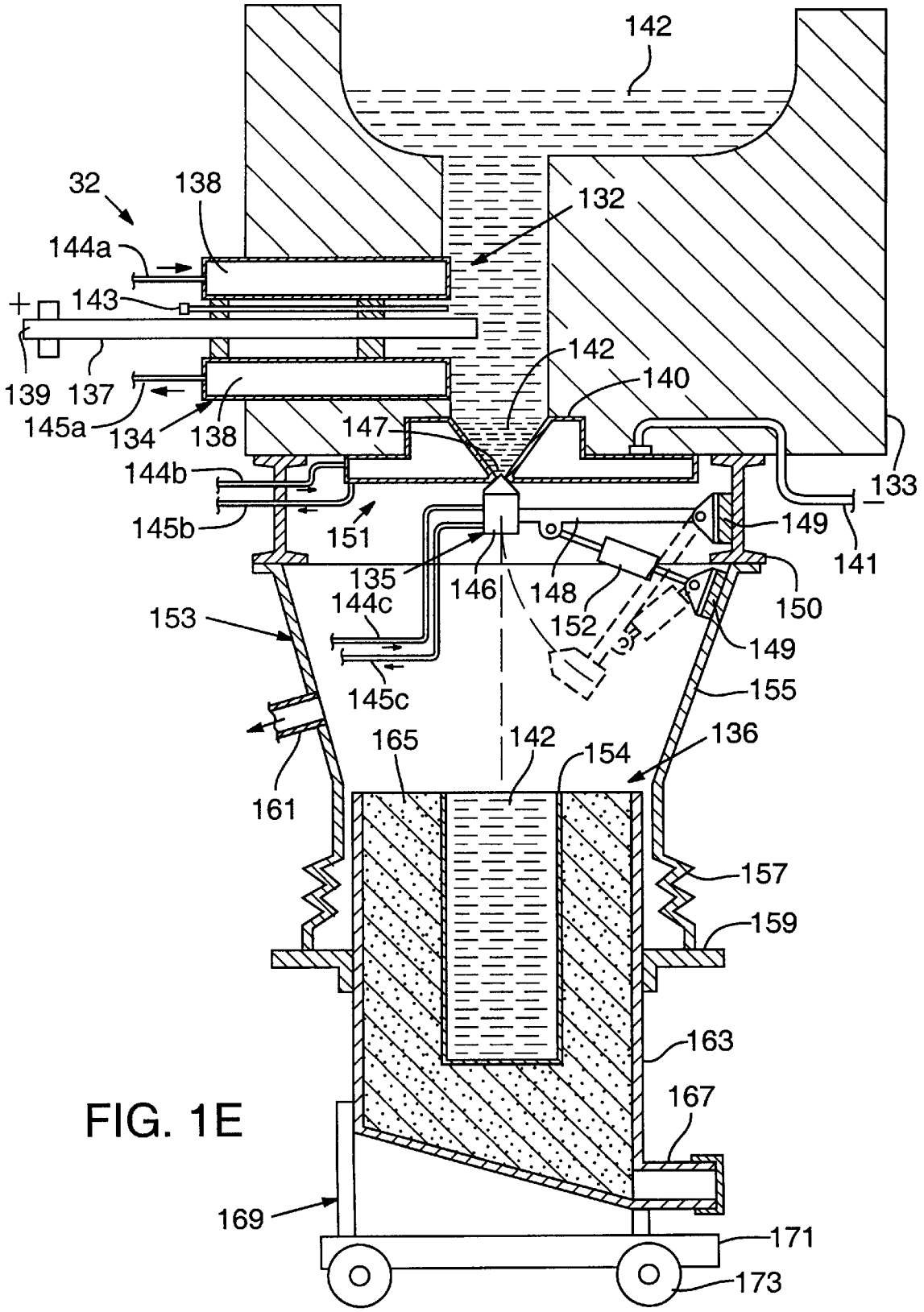
FIG. 1E is a cutaway drawing showing details of glass tap and container fill (slag processing) subsystem of the reactor system of FIG. 1A.

The first 30 and second 32 discharge processing subsystems can be of substantially identical construction. However, it will be noted that the discharge port 130 (FIG. 1A) of the first subsystem 30 is located at a higher location within the bed 70 due to the metal/slag separation, whereas the discharge port 132 of the second subsystem 32 is located at the bottom of bed 72 in the lowest portion of refractory lined floor 133 of chamber 24, reflecting the lack of metal in the joule effect zone. Details of the second subsystem 32 are shown in FIG. 1E, it being appreciated that the details of the first subsystem 30 can be the same in all important respects.

Generally, the subsystem 32 includes a discharge cavity heating assembly 134, a thimble valve assembly 135, and a container filling assembly 136. Heating assembly 134 includes a solid electrode bar 137 supported by a water-cooled electrode holder 138, all of which are fitted through a portion of refractory lined floor 133 such that they slightly penetrate into discharge port 132. Electrode bar 137 is preferably made from a high temperature metal such as molybdenum and receives high voltage electric energy from an electrically conductive wire 139. Heating assembly 134 also includes a hollow, tubular drain ring 140, having a hollow flange, that is adapted to form the bottom of discharge port 132. A high voltage electric power conductor 141 is connected to drain ring 140 and cooperates with wire 139 to provide high electric current flow to glass 142 within discharge port 132. Due to its poor conductivity, glass 142 offers high resistance and converts the electrical energy to heat, becoming molten or semi-molten. The voltage to electrode bar 137 can be increased to bring glass 142 to a fully molten phase to facilitate discharge from discharge port 132 or decreased to return glass 142 to a semi-molten state. The phase of glass 142 is monitored by a thermocouple 143 that is also supported by electrode holder 138. The hollow spaces within electrode bar 137 and drain ring 140 are supplied with circulated cooling water through inlet lines 144*a* and 144*b*, respectively, and outlet lines 145*a* and 145*b*, respectively.

Thimble valve assembly 135 includes a hollow cylindrical thimble plug 146 with a conical end 147 and is connected to an actuator rod 148 that is hingibly connected through an electrical insulator 149 to a structural member 150 of process chamber 151. The hollow space in plug 146 is water cooled via flexible hoses with inlets 144*c* and outlets 145*c*. An actuator 152, connected between actuator rod 148 and a discharge shroud 153, can be pneumatically, hydraulically, or electrically activated to move actuator rod 148 and swing thimble plug 146 away from drain ring 140 to allow molten glass to pour into inner container 154 of filling assembly 136.

Discharge shroud 153 employs a guard pipe wall 155 that is connected between structural member 150 and a flexible boot 157 having a loading flange 159 to contain splashes of molten glass 142. A vent 161 in guard pipe wall 155 is connecter to a filtered air exhaust system. Loading flange 159 is adapted to form an airtight seal about the outside of an outer container 163 for holding a ceramic cooling media 165 that supports inner container 154. Ceramic cooling media 165 functions as a heat sink to prevent thermal damage to inner container 154 from the heat of molten glass 142. A discharge pipe 167 on the outside of outer container 163 permits the level of ceramic cooling media 165 to be adjusted or emptied.

Outer container 163 is placed on platform structure 169 of a dolly 171 with wheels 173. Dolly 171 can be positioned underneath discharge shroud 153, the flexible boot 157 of which can be lowered and raised to respectively engage or disengage loading flange from outer container 163. When inner container 154 is full, dolly 171 is moved to a cooling area, and when glass 142 is cooled, inner container 154 can be removed from the outer container 163.

With reference again to FIG. 1A, the gaseous effluent processing subsystem 26 receives gases from the second chamber 24 and, depending on the chemistry and objectives of the overall reaction process, processes the gases to reduce hazardous content and/or to recover energy or a clean fuel by-product for enhanced system efficiency. A number of alternative embodiments of the subsystem 26 are described in greater detail below. FIG. 1A shows an initial component of the subsystem, namely, a high temperature filter 158. Additional components are indicated as box 156 for purposes of illustration. The illustrated high temperature filter 158 includes a ceramic candle filter element 160 located in a cupola above the second chamber 24. The filter 158 receives effluent gases at a temperature of about 1800° F. The gases can be cooled slightly by injecting steam or gas into the effluent stream through nozzle 162. The candle filter element 160 removes particulates having a size greater than about 0.3 micron. A gas supply 164 is used to backflush the candle filter element 160 using, for example, air, steam or nitrogen. The backflushed particulates will settle into the bed 72. The exhaust from the high temperature filter 158 passes to additional components, as will be described below, for further processing.

Figure 2:
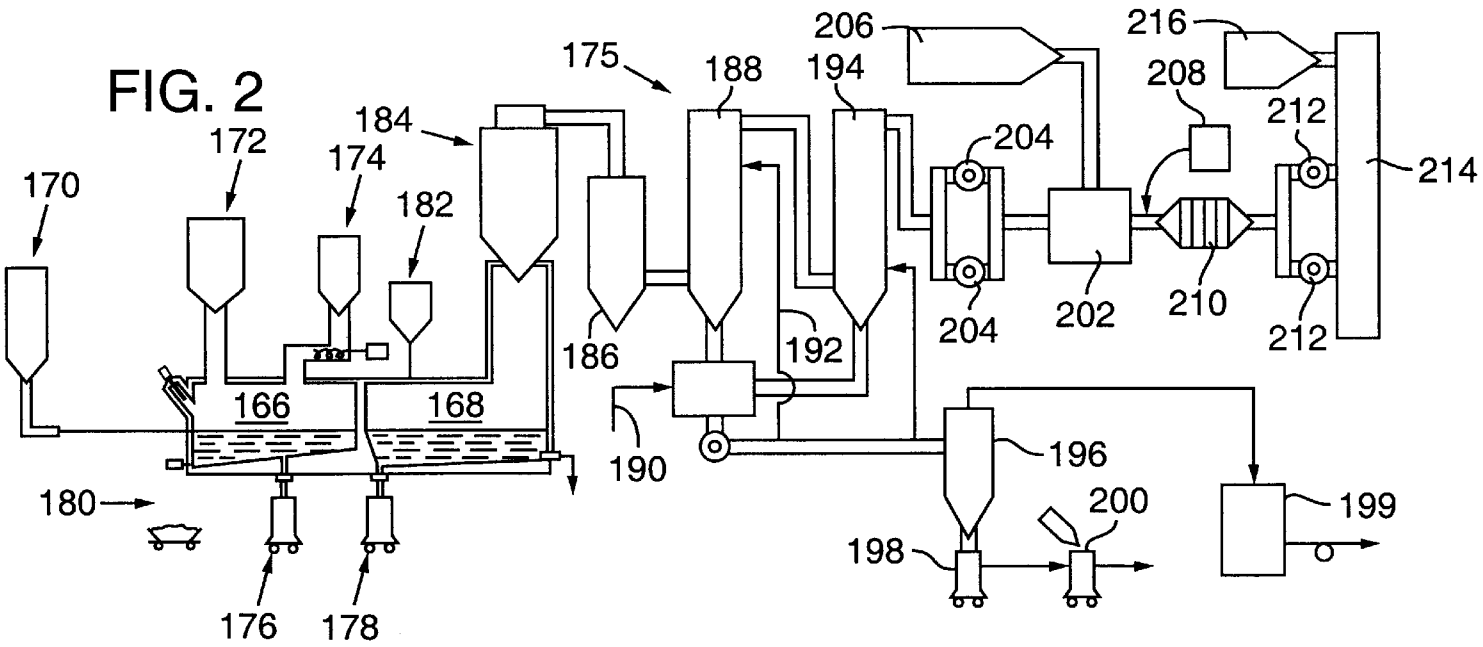
FIG. 2 is a schematic diagram showing a waste processing system incorporating a multi-zone reactor in accordance with the present invention.

Referring to FIG. 2, a schematic diagram of the waste processing system 175 including a multi-zone reactor according to the present invention is shown. The illustrated system 175, including the various components for filtering and scrubbing the gaseous effluent, is applicable for operation in an oxidation mode or in a reduction mode to yield convertible synthesis gas (syngas) products. However, certain conversion components as set forth below are particularly applicable for reduction mode operation. A number of components of the system 175 generally correspond to components of the reactor system 10 of FIG. 1 and the description of such components will not be repeated. In particular, the system 175 includes a plasma torch heated reactor chamber 166, a joule effect heated chamber 168, a liquid waste feed subsystem 170, solid waste feed subsystems 172 and 174, slag recovery subsystems 176 and 178, discharge recycling subsystem 180, reactant injection subsystem 182, and a high temperature filter 184, all generally corresponding to like components as described above. The remaining effluent processing components of system 175 are described below with respect to reduction mode operation.

As previously noted, the exhaust from the high temperature filter 184 in reduction mode operation is a mixture of CO, $CO_2$, $H_2$, $CH_4$ and trace amounts of other organic gases having a temperature of about 1800° F. This gas has a recoverable energy equal to approximately 300 to 400 btu per cubic foot. Such energy can be recovered by burning the gas in a boiler or using the gas as a fuel in a combustion engine, a turbine or a hydrogen fuel cell. However, before the gas can be recovered, its impurities such as acidic gases and low boiling point metal vapors should be removed to a great extent.

In this regard, the exhaust from the high temperature filter 184 is first sent to a rapid quench tower 186 which reduces the gas temperature from approximately 1800° F. to less than about 250° F. in less than one second. The quench tower 186 is equipped with a number of water spray nozzles that spray concurrently with the effluent gas flow thereby dissipating heat from the syngas. Exhaust from the quench tower 186 is preferably received by a dual vessel scrubber including an alkaline scrubber unit 188 and an acid scrubber unit 194. The scrubber units 188 and 194 can be constructed from any of various materials such as steel, plastic or fiberglass. In the illustrated embodiment, the alkaline scrubber unit 188 comprises a vessel where the syngas enters through an inlet port located in a lower portion of the vessel and exits the vessel through a port located in a upper section of the vessel. In the middle of the vessel, there are separate support plates which house packing material. A scrubbing liquid, which is water mixed with reagents, is sprayed into the syngas stream in the vessel. Some of the liquid sprayed into the syngas stream is collected in a tank 190 disposed beneath the unit 188. A recirculation pump continually recirculates liquids from this tank together with supplemental reagents to the scrubber unit 188 as generally indicated by arrow 192. Preferably, the pH of the scrub solution is feedback regulated. That is, when the pH of the scrub solution deviates from the setpoint, a reagent pump introduces additional reagents into the recirculation tank 190. The reagent may comprise for example NaOH or CaOH which is effective to convert halogen gases to a salt such as NaCl or CaCl. Sulfur is removed as $H_2S$. Upon exiting the alkaline scrub unit 188, the syngas is delivered to an acid scrub unit 194. The acid scrub unit 194 is similar in construction to the alkaline scrub unit 188 but operates at a pH of approximately 6.9 (using NaOH as a reagent) whereas the alkaline unit 188 operates at a pH of approximately 11. The acid scrub unit 194 removes HCl, HI, and $SO_2$. The recirculation tank 190 has an outlet for recovered scrubber liquid or so-called "blow down." The blow down is sent to an evaporator 196 for concentrating the blow down. The concentrates from the evaporator 196 is collected in a tank unit 198 and then stabilized with a reagent in a mixing tank 200 for reuse. The distillate from evaporator 196 is collected a tank 199 and is pumped, for example, back to acid scrub unit 194, for use as make-up water.

The syngas discharged from the acid scrub unit 194 is clean and can be used for energy recovery. This gas is driven from the acid scrub unit 194 to plenum unit 202 by redundant fan blowers 204. The plenum unit 202 also communicates with building ventilation system 206.

At this point in the process, any of various syngas converters, generally identified by the referenced numeral 208, may be employed. Various syngas converter options will be described in detail below. Generally, syngas conversion is can encompass either energy recovery (e.g., steam generation, gas turbine, combustion engine, or hydrogen fuel cell) or direct conversion to a stable gas by oxidation (e.g., flare, catalytic converter, or regenerative conversion). The exhaust from the syngas converter 208 is received by a filter bank to 210. The filter bank 210 preferably includes a series of filters including, for example, prefilters, high efficiency particulate absolute (HEPA) filter elements, and charcoal filters. The HEPA filter elements are cloth or fiber elements capable of removing about 99.97% of the particulates above 0.3 microns. The charcoal filters include activated carbon filter and impregnated carbon elements for removing mercury and volatile organic gases. From the filter bank 210, the gas is driven by a single or redundant exhaust fans 212 to stack 214. The gases passing through stack 214 are monitored by continuous activity monitors and continuous emission monitors, generally identified by reference numeral 216 to insure that emissions from the stack 214 to the environment are within acceptable limits.

Figure 3A:
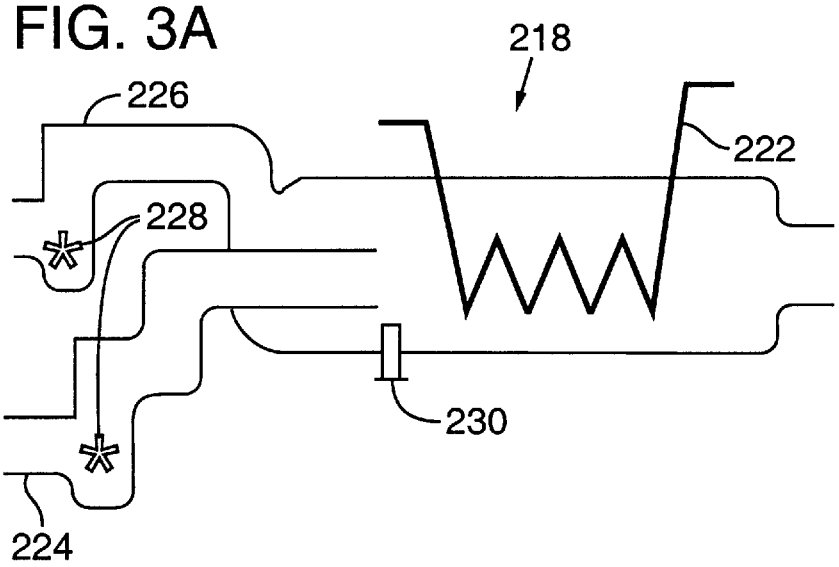
FIGS. 3A through 3D show alternative embodiments of a synthesis gas conversion subsystem in accordance with the present invention.

FIGS. 3A through 3D illustrate some of the syngas converter options. Referring first to FIG. 3A, a steam recovery option is illustrated. In this option, the energy of the syngas is utilized to generate steam for use in the reactor system or elsewhere. The illustrated steam recovery subsystem 218 includes a burner chamber 220 and a tube heat exchanger 222. The burner chamber includes a first input receiving syngas from the reactor chambers and a second input 226 for receiving air. The syngas and air are propelled by fans 228. In the burner chamber 220 the syngas and air mix and are ignited by igniter 230. The heat from this combustion heats water passing through the heat exchanger tube 222 to form steam.

Figure 3B:
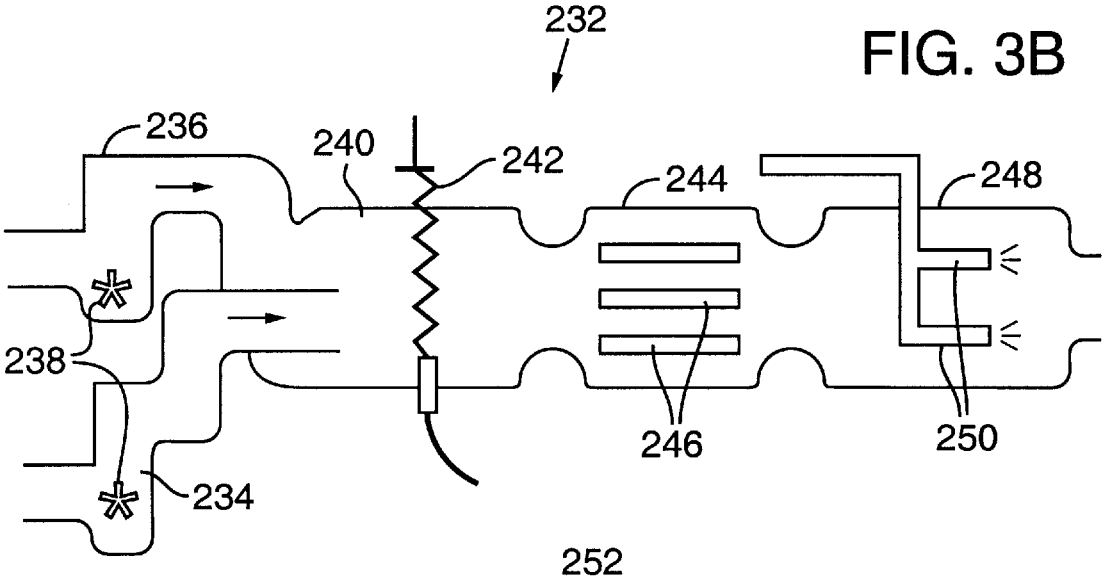

FIG. 3B shows a catalytic converter option 232. Similar to the previously described option, the catalytic converter 232 includes a first input 234 for receiving syngas from the reactor chambers and a second input 236 for receiving air. The air and syngas are propelled by fans 238. The syngas and air mix in a gas heating section 240 where the gas is heated to approximately 900° F. by heater element 242. From the heating section 240, the heated gas passes into gas reaction zone 244. In the gas reaction zone 244, the gas passes across catalyst plates 246 coated with platinum and the gases oxidize to a temperature of approximately 1200° F. Finally, the oxidized gases pass into quencher section 248 where the gases are quenched by water delivered through nozzles 250.

Figure 3C:
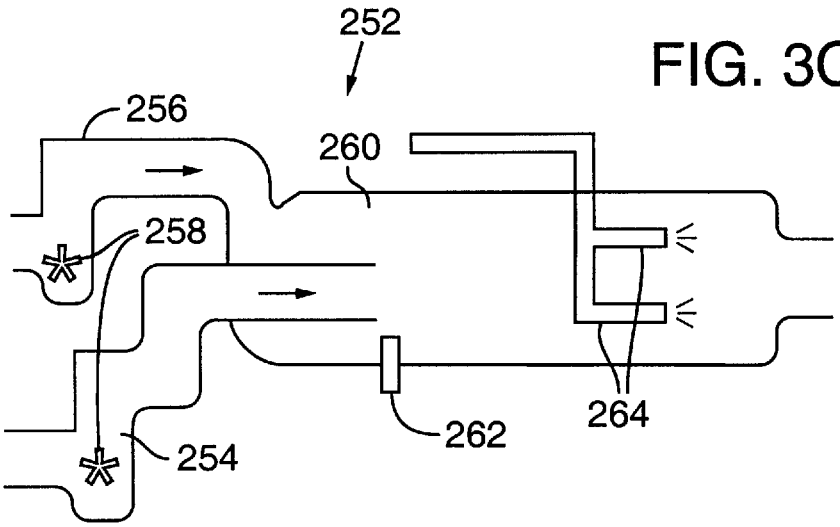

FIG. 3C shows a flare conversion option 252. As in the previous options, the flare converter 252 includes a first inlet 254 for receiving syngas from the reactor chambers and a second inlet 256 for receiving air. The air and syngas are driven by fans 258 and mix in flare vessel 260. In the flare vessel 260, the mixture is ignited by igniter 262. The resulting combustion product is then quenched by water delivered through nozzles 264 thereby cooling the combustion product to approximately 150° F.

Figure 3D:
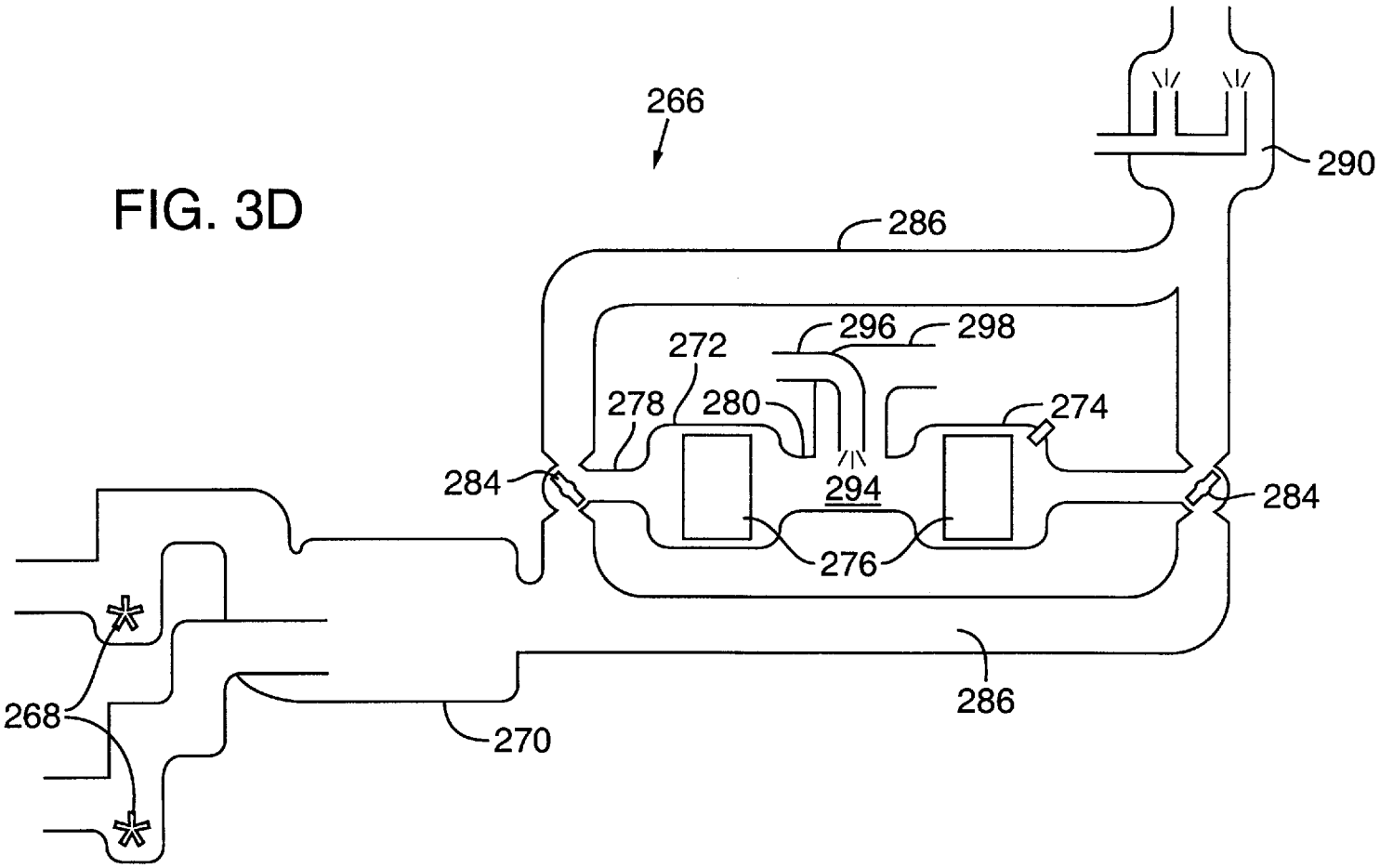

FIG. 3D shows a regenerative converter 266. Fans 268 drive syngas and air into a conversion section 270 where the syngas and air mix. The mixture then passes to a conversion device that includes two conversion vessels 272 and 274. Each vessel 272 and 274 has internal support plates 276 that house a silica or alumina based heating medium. The first vessel 272 has a gas inlet port 278 and a gas outlet port 280. The outlet port 280 of the first vessel 272 is connected to an inlet port 282 of the second conversion vessel 274. Each of the two conversion vessels 272 and 274 is associated with a three-way damper 284 and bypass flow ducts 286 that allow reversing the flow either from the second vessel 274 to the first vessel 272 or vice versa. The outlet port 288 of the second conversion vessel 274 is connected to a quench unit 290 where the gas is quenched by water from nozzles 292. In addition, a gas-fired burner 294 is mounted in the pipe that connects the conversion vessels 272 and 274. The burner 294 includes a first inlet 296 for receiving fuel such as propane or natural gas and a second inlet 298 for receiving air.

In operation, the gas-fired burner 294 is turned on to initiate the converter process. Due to the prevailing gas flow from the first conversion vessel 272 to the second conversion vessel 274 the heating medium in the second vessel will heat up to the desired temperature of 1500° to 1800° F. Once this temperature is reached, the syngas and air is allowed to flow in the reverse direction to the unheated first vessel 272. The syngas converts to $H_2O$ and $CO_2$ in the second vessel 274 generating heat from the reaction of $H_2$ and CO with oxygen. The hot gas flows to the first conversion vessel 272 thereby heating the medium in the first vessel 272. A temperature sensor (not shown) senses the heat in the second vessel 274 and, if the temperature drops below the desired level, operates the three-way dampers 284 to reverse the flow of gas such that the flow is from the first vessel 272 to the second vessel 274. It will be appreciated that the dampers 284 can be operated as appropriate whenever the temperature of either vessel drops below the desired temperature of approximately 1500° to 1800° F. If this temperature cannot be maintained, a propane or natural gas valve 294 is automatically turned on to introduce gas into the incoming syngas stream. The additional propane or natural gas will oxidize in the hot bed, thus providing additional heat to raise the bed temperature. This method of conversion promotes complete reaction of the syngas such that the syngas is converted into a stable form—water vapor and $CO_2$. The quencher unit 290 cools the gas discharged from the converter 266 to approximately 150° F.

Figure 4:
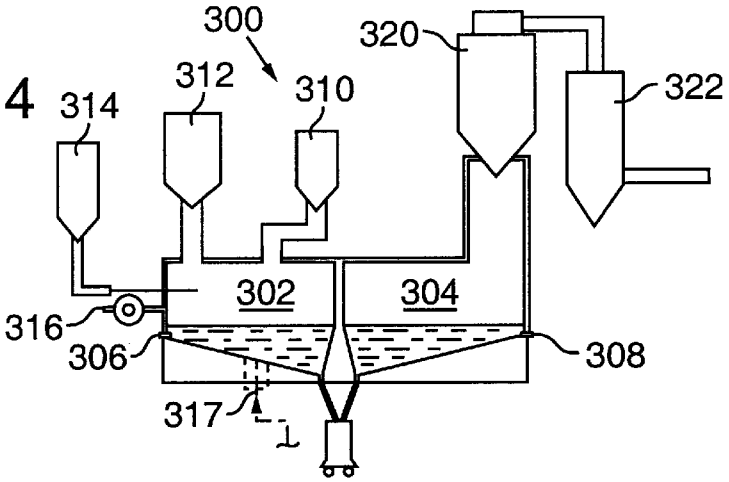
FIG. 4 is a schematic diagram showing an alternative embodiment of a multi-zone reactor system according to the present invention.

Referring to FIG. 4, an alternative embodiment of the multi-zone processing chamber is generally identified by reference numeral 300. The illustrated reactor system 300, includes a first chamber 302 and a second chamber 304 that are heated by joule effect heaters 306 and 308, respectively. The illustrated reactor system 300 is particularly applicable for treating waste that is free from, or has been treated to remove, metallic materials. However, the reactor system 300 is suitable for treating a variety of wastes, including compressible solid, relatively incompressible solid, and liquid or slurry waste. In this regard, the system 300 includes first 310 and second 312 solid waste feed subsystems as well as a liquid waste feed subsystem 314 similar to those that have been described previously. The system 300 also includes a reactant injection subsystem 316 for injecting air, oxygen, steam, or another reactant into the first chamber 302 to facilitate more complete reaction of the gaseous effluent. Reactant injection subsystem 316 may be positioned at the bottom of the molten bath or through the side or top of the reactor and may include a watercooled bubbler tube 317 through which the reactant is injected. It will be appreciated that the discharge from the reactor beds of the first and second chambers 302 and 304 will comprise slag that is substantially free from recyclable metals. Accordingly, a single slag recovery subsystem 318 can be employed to recover slag from each of the chambers 302 and 304. The gaseous effluent from the second chamber 304 can be treated by a high temperature filter 320, a quench tower 322 and additional components (not shown) as described above.

Figure 5:
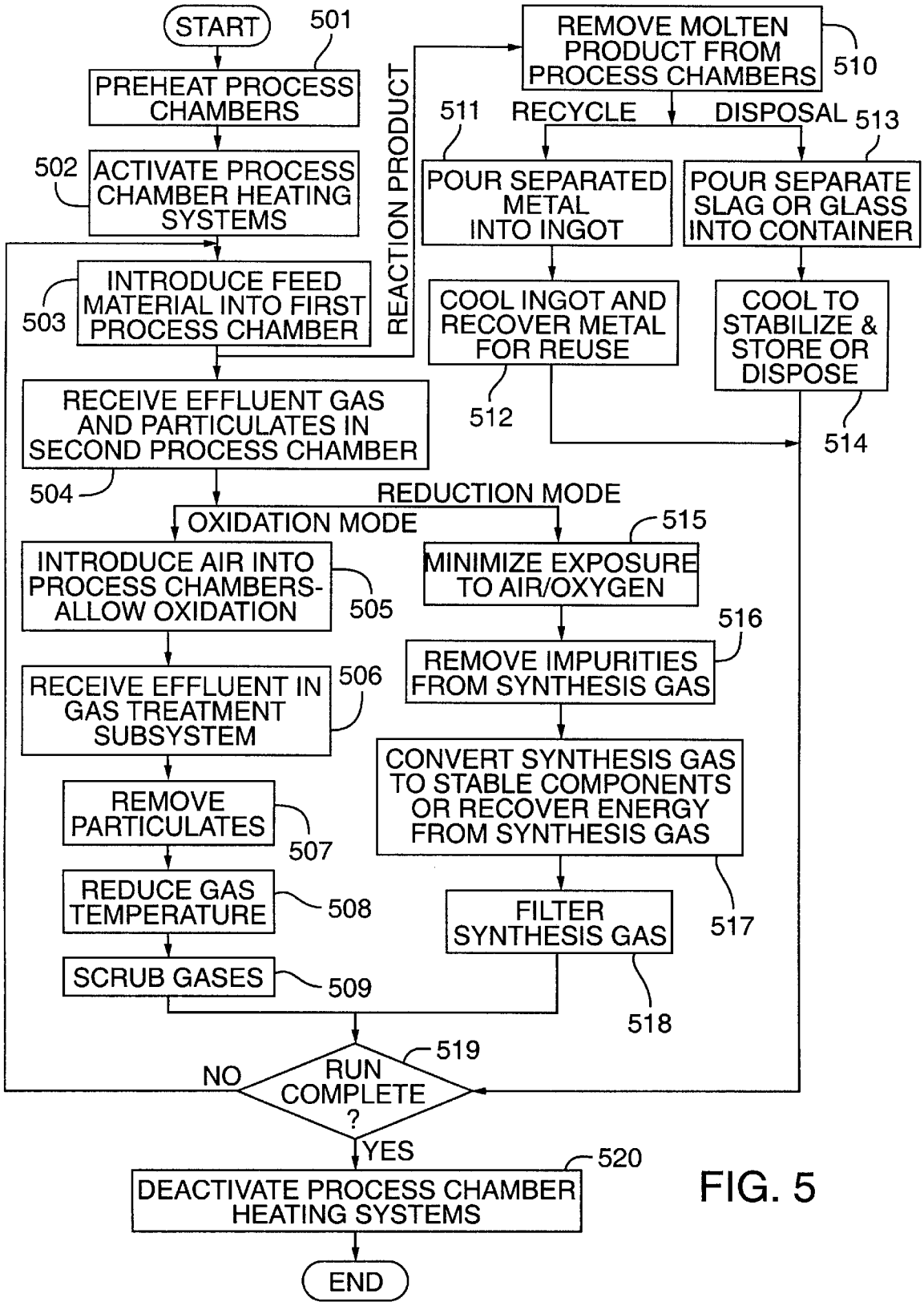
FIG. 5 is a flow chart illustrating waste treatment processes in accordance with the present invention.

Various process options of the present invention can be summarized by reference to the flow chart of FIG. 5. The process according to the present invention can be initiated by preheating (501) the process chamber of a multi-zone reactor using a conventional gas fuel heating system. Once the process chambers are sufficiently preheated, the chamber heating systems, e.g., plasma torch or joule effect heaters, are activated (502) and waste feed material is introduced (503) into the first of the process chambers. In the first process chamber the waste is reacted to yield, depending on the nature of the waste, slag, recyclable metals, and a gaseous effluent. The gaseous effluent including particulates is received (504) in the second process chamber. The processing of the effluent will vary depending on whether the reactor system is operated in an oxidation mode or in a reduction mode. In the oxidation mode, air is introduced (505) into the process chambers, for example, by using air as the gas for operating the plasma torch or by ventilizing one or both of the chambers. Upon exiting the second chamber, the effluent is received (506) in a gas treatment subsystem that removes (507) particulates, reduces (508) the gas temperature and scrubs (509) the gas, among other things. In the reduction mode, exposure to air or oxygen is minimized (515), for example, by employing air locks on the process chambers and using an inert gas such as nitrogen as the operating gas for the plasma torch. Upon exiting the processing chambers, impurities are removed (516) from the synthesis gas. The synthesis gas can then be converted (517) to stable gases or energy can be recovered from the synthesis gas. Finally, the synthesis gas is filtered (518) prior to release to the ambient environment.

With regard to the molten reaction products, such molten products are removed (510) from the process chambers for recycling or disposal. In this regard, recyclable metallic materials may be recovered from the plasma heated zone. The chemistry of the reaction is adjusted so that the molten metal and slag is phase separated in the plasma torch heated zone. Subsequently, the recyclable metal is poured (511) into an ingot and cooled (512) for recovery and reuse. The slag is separately poured (513) into a glass container and cooled (514) to stabilize the slag for storage or disposal. If the waste treatment run is not complete (519), additional waste can be introduced into the first chamber and the process continues. Once the supply of waste feed is exhausted, the process chamber heating systems are deactivated (520) and the process is complete.

While various embodiments and applications of the present invention have been described in detail, it is apparent that further modifications and adaptations of the invention will occur to those skilled in the art. However, it is to be expressly understood that such modifications and adaptations are within the spirit and scope of the present invention.

I claim:

1. A method for processing waste, comprising the steps of:

employing a plasma type heater to heat a first reactor chamber having a first reactor bed;

employing a second heater to heat a second reactor chamber having a second reactor bed;

introducing waste into said first reactor chamber;

reacting at least a portion of said waste in said first reactor chamber to yield a first reaction product in said first reactor bed and a first effluent outside of said first reactor bed;

introducing said first effluent into said second reactor chamber the second reactor bed being separated from the first reactor bed to prevent the first reaction product from the first reactor bed from entering the second reactor bed;

reacting at least a portion of said effluent in said second reactor chamber to yield a second reaction product in said second reactor bed and a second effluent outside of said second reactor bed; and separately processing said reaction products and said second effluent.

2. A method as set forth in claim 1, wherein the plasma type heater comprises a plasma torch.

3. A method as set forth in claim 2, wherein said step of heating said first reactor bed comprises bringing said first reactor bed to a temperature of at least 2,000° F.

4. A method as set forth in claim 3, wherein said step of heating said first reactor bed comprises bringing said first reactor bed to a temperature of about 2,500° F.

5. A method as set forth in claim 2, wherein first reactor bed comprises a joule effect heater.

6. A method as set forth in claim 2, wherein said second reactor bed comprises a joule effect heater.

7. A method as set forth in claim 2, wherein a shadow wall separates the first reactor chamber from the second reactor chamber.

8. A method as set forth in claim 2, wherein said step of introducing waste comprises operating a pump to introduce a liquid waste material containing an organic compound.

9. A method as set forth in claim 1, wherein said step of reacting at least a portion of said waste comprises disintegrating organic compounds.

10. A method as set forth in claim 1, wherein said step of reacting at least a portion of said effluent comprises operating in an oxidative mode by exposing said first effluent to a source of oxygen.

11. A method as set forth in claim 1, wherein said step of reacting at least a portion of said effluent comprises operating in a reduction mode by reducing the amount of oxygen present in said second chamber.

12. A method as set forth in claim 1, wherein said step of reacting at least a portion of said effluent comprises exposing said effluent to a source of oxygen.

13. A method as set forth in claim 1, wherein said step of reacting at least a portion of said effluent comprises introducing steam into said second chamber.

14. A method as set forth in claim 1, wherein said step of reacting at least a portion of said effluent comprises operating in a reduction mode to yield a synthesis gas that can be used as a fuel.

15. A method as set forth in claim 1, wherein said step of separately processing comprises removing particulates from said effluent.

16. A method as set forth in claim 1, wherein said step of separately processing comprises removing acid gases from said effluent.

17. A method as set forth in claim 1, wherein said step of separately processing comprises converting a portion of said second effluent into a stable gaseous compound that can be discharged to the atmosphere.

18. A method as set forth in claim 1, wherein said step of separately processing comprises recovering energy from said second effluent.

19. A method as set forth in claim 1, wherein said step of separately processing comprises draining a molten waste product from said second reactor chamber.

20. A method as set forth in claim 1, further comprising the step of extracting said first reaction product from said first reactor chamber.

21. A method as set forth in claim 1, wherein said first reaction product comprises a metallic material and said method further comprises the steps of inducing a phase separation of said metallic material from slag in said first reactor bed and allowing said metallic material to pour from said first reactor chamber into an ingot.

22. A method as set forth in claim 1, further comprising the step of stabilizing said first reaction product.

23. A method as set forth in claim 1, further comprising the step of vitrifying said first reaction product.

24. An apparatus including a reactor for treating waste, comprising:

a first reactor chamber in the reactor containing a first reactor bed, wherein the waste is reacted to yield a first reaction product in the first reactor bed and a first effluent outside of the first reactor bed;

a plasma torch heater for heating the first reactor chamber;

a waste inlet through which waste is deliverable into the first reactor chamber;

a second reactor chamber in the reactor, containing a second reactor bed, for receiving and reacting at least a portion of the first effluent, wherein the first effluent is reacted to yield a second reaction product in the second reactor bed and a second effluent outside of the second reactor bed, the second reactor bed being separated from the first reactor bed such that the first reaction product in the first reactor bed is prevented from flowing into the second reactor bed; and a second heater for heating the second reactor chamber.

25. An apparatus as set forth in claim 24, wherein the second heater is of a type different from the plasma torch.

26. An apparatus as set forth in claim 24, wherein the second heater comprises a joule effect heater.

27. An apparatus as set forth in claim 24, wherein the reactor comprises a refractory lined vessel.

28. An apparatus as set forth in claim 24, wherein each of the first and second reactor beds comprises a molten bath.

29. An apparatus as set forth in claim 24, further comprising a liquid waste feed subsystem for introducing a liquid waste containing an organic compound into the first reactor chamber.

30. An apparatus as set forth in claim 29, further comprising a shadow refractory wall disposed between the first and second chambers.

31. An apparatus as set forth in claim 29, further comprising a solid waste feed subsystem for introducing solid wastes into the first reactor chamber, the solid waste including at least one compound of a metallic material, a cellulose, a plastic, or a hazardous organic material.

32. An apparatus as set forth in claim 24, further comprising first and second drains for draining molten waste product from the first and second reactor beds respectively.

33. An apparatus as set forth in claim 24, further comprising an effluent processing system including a filter for removing particulates from the second effluent.

34. An apparatus as set forth in claim 33, wherein the effluent processing system comprises means for removing hazardous metals from the second effluent.

35. An apparatus as set forth in claim 34, wherein the effluent processing system comprises means for removing acid gases from the effluent.

36. An apparatus as set forth in claim 33, wherein the effluent processing system comprises means for converting a portion of the effluent into a stable gaseous compound that can be discharged to the atmosphere.

37. An apparatus as set forth in claim 33, wherein the effluent processing system comprises means for synthesizing a portion of the effluent to yield a useful byproduct.

38. An apparatus as set forth in claim 37, wherein the effluent processing system comprises means for recovering energy from the effluent.

39. An apparatus as set forth in claim 24, wherein the first reactor bed is heated by a joule effect heater.

40. An apparatus as set forth in claim 24, wherein the first reaction product comprises a metallic material and the first reactor bed is adapted for inducing a phase separation of the metallic material from slag and allowing the metallic material to pour from the first reactor chamber into an ingot.

41. An apparatus including a reactor for treating waste, comprising:

a first reactor chamber in the reactor containing a first reactor bed, wherein the waste is reacted to yield a first reaction product in the first reactor bed and a first effluent outside of the first reactor bed;

a plasma torch heater for heating the first reactor chamber;

a liquid waste inlet through which liquid waste containing an organic compound is deliverable into the first reactor chamber;

a second reactor chamber in the reactor, containing a second reactor bed, for receiving and reacting at least a portion of the first effluent, wherein the first effluent is reacted to yield a second reaction product in the second reactor bed and a second effluent outside of the second reactor bed, the second reactor bed being separated from the first reactor bed such that the first reaction product in the first reactor bed is prevented from flowing into the second reactor bed;

a second heater for heating the second reactor chamber;

a shadow wall disposed between the first and second reactor chambers having openings through which the first effluent flows to reach the second reactor chamber; and an effluent processing system for processing the second effluent.

* * * * *

UNITED STATES PATENT AND TRADEMARK OFFICE

CERTIFICATE OF CORRECTION

PATENT NO. : 5,809,911

DATED : September 22, 1998

INVENTOR(S) : FRED FEIZOLLAHI

It is certified that error appears in the above-identified patent and that said Letters Patent is hereby corrected as shown below:

Column 2, line 65, after "depending" delete --a--.

Column 10, line 17, after "conversion" delete --is--.

Column 12, line 6, change "watercooled" to --water-cooled--.

Column 13, line 13, claim 1, after "chamber" insert --,--.

Signed and Sealed this

Thirtieth Day of November, 1999

*Attest:*

*Attesting Officer*

Q. TODD DICKINSON

*Acting Commissioner of Patents and Trademarks*